US005645212A

United States Patent [19]

Potter

[11] Patent Number: 5,645,212

[45] Date of Patent: Jul. 8, 1997

[54] FOLDABLE DISPLAY TRAY

[75] Inventor: Jerry L. Potter, Greensboro, N.C.

[73] Assignee: Packaging Resources, Inc., Greensboro, N.C.

[21] Appl. No.: 564,821

[22] Filed: Nov. 29, 1995

[51] Int. Cl.[6] ..... B65D 5/355

[52] U.S. Cl. ..... 229/101; 229/144; 229/148; 229/169; 229/178

[58] Field of Search ..... 229/101, 117.07, 229/123, 125.37, 144, 148, 169, 170, 178

[56] References Cited

U.S. PATENT DOCUMENTS

| | | | |
|---|---|---|---|
| 1,230,552 | 6/1917 | Bain | 229/101 |
| 3,154,052 | 10/1964 | Sweeney | 229/101 |
| 3,170,618 | 2/1965 | Sweeney | 229/144 |
| 3,581,975 | 6/1971 | Riccio | 229/101 |
| 4,306,658 | 12/1981 | Montealegre | 229/101 |
| 4,340,169 | 7/1982 | Webinger | 229/101 |
| 4,791,883 | 12/1988 | Lehman et al. | 229/101 |
| 5,071,062 | 12/1991 | Bradley et al. | 229/101 |
| 5,249,550 | 10/1993 | Hines et al. | 229/101 |
| 5,361,895 | 11/1994 | Wilson et al. | 229/101 |

FOREIGN PATENT DOCUMENTS

| | | | |
|---|---|---|---|
| 2602744 | 2/1988 | France | 229/101 |
| 2206563 | 1/1989 | United Kingdom | 229/125.37 |

*Primary Examiner*—Gary E. Elkins

[57] ABSTRACT

A display tray formed from corrugated or solid fiber paper is useful for packaging, shipping, displaying and transportation of various goods. The tray includes a planar bottom which has a central and two extreme sections formed by a pair of parallel score lines. Opposing ends and sides are joined to the bottom and each side includes a pair of vertical and angular score lines which intersect proximate the bottom score lines for folding purposes. The tray can be easily changed from an open to either a partially or fully closed tray by manually bending along the sides at the described score lines to rotate the end assemblies.

19 Claims, 9 Drawing Sheets

FOLDABLE DISPLAY TRAY

BACKGROUND OF THE INVENTION

1. Field of the Invention

The invention herein pertains to display trays and particularly to display trays formed from corrugated paper which can be used for packing, storing, marketing and transportation of merchandise. The tray includes end assemblies which can be folded and unfolded as necessary for inserting and removing the contained merchandise.

2. Description of the Prior Art and Objectives of the Invention

Various types of trays have been formed from corrugated paper in the past for use in packaging and shipping different kinds of merchandise. Such trays are generally cut from a flat corrugated sheet and are then folded along score lines to form a tray for containing various goods. Adhesives, tapes, staples, tabs and other means have been utilized in the past to hold the tray in its final folded form. Some such trays include a hinged lid which can be opened and closed while other conventional trays include lids or covers which are completely removable for return as needed to cover the tray. Other standard trays have partial lids which are glued in place so the merchandise within can be seen, but cannot be easily removed without destroying the integrity of the tray.

Thus, with the disadvantages and inconveniences of prior display trays, the present invention was conceived and one of its objectives is to supply a foldable corrugated display tray which can be manufactured by conventional methods and which is easy to assemble and use by both the manufacturer and consumer.

It is also an objective of the present invention to provide a display tray in which merchandise contained therein can be easily viewed by the consumer while the tray is closed at the point of purchase.

It is another objective of the invention to provide a foldable display tray which will allow merchandise to be easily removed by unfolding one or both end assemblies.

It is yet another objective of the invention to supply a display tray having locking notches to maintain the end assemblies in their folded or closed configuration.

It is a further objection of the invention to provide a display tray which will not readily deform when stacked.

Other objectives and advantages of the present invention will become apparent to those skilled in the art as a more detailed presentation is set forth below.

SUMMARY OF THE INVENTION

A display tray is formed from corrugated paper or solid fiber with score lines along the sides and bottom to allow one or both end assemblies to be selectively opened or likewise closed as required. The end assemblies can be fully opened for packing merchandise and thereafter can be closed for shipment and storage. Only one end assembly can be opened at a time for removing merchandise as needed by a consumer. The display tray includes pairs of score lines along the sides consisting of a vertical and a 45° score line which intersect at the bottom. The sides are joined to or integrally formed with a planar bottom which has a pair of parallel score lines thereacross which divide the bottom into a large central and two smaller extreme sections. A pair of ends, also joined to the bottom are attached to the sides by gluing, in one embodiment, to complete the tray. Notches in the corner of the tray allow for locking of the tray when the end assemblies are in a folded or closed configuration. The folded configuration adds structural strength to the display tray to allow high stacking while protecting the contents thereof.

DESCRIPTION OF THE PREFERRED EMBODIMENT

Figure 1:
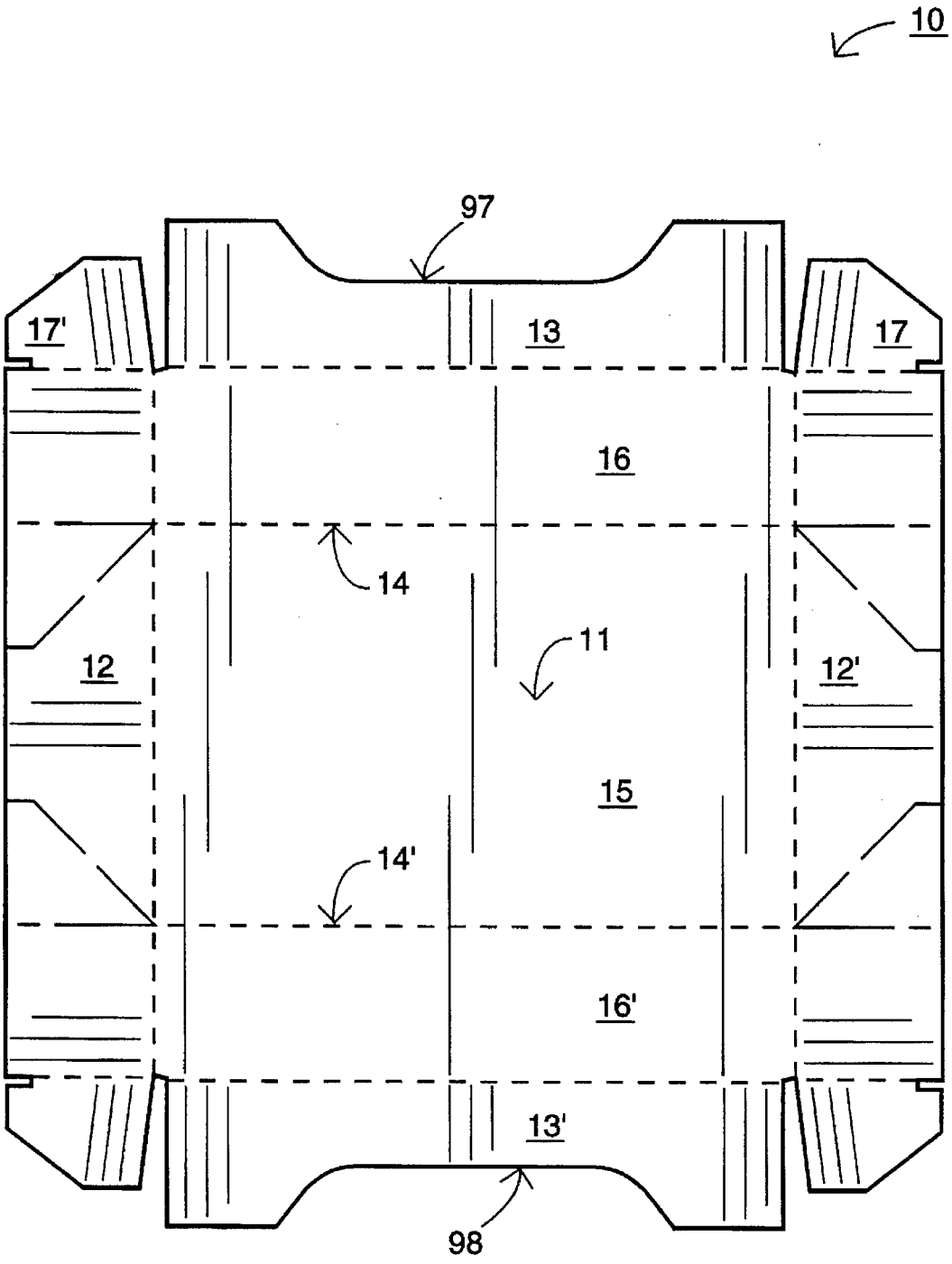
FIG. 1 shows the preferred form of the invention in a flat, unassembled configuration.
Figure 2:
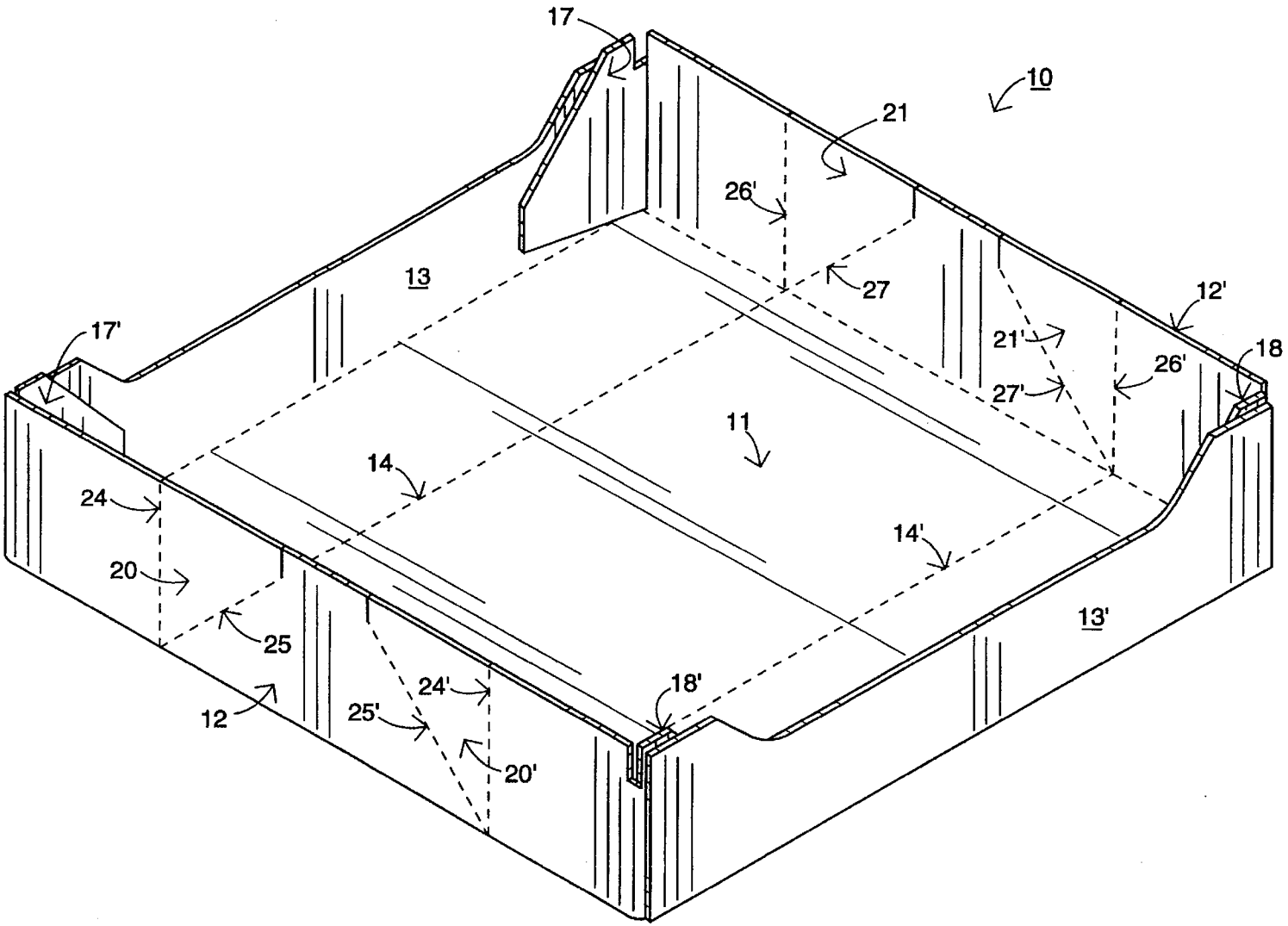
FIG. 2 demonstrates a perspective view of the tray as seen in FIG. 1 after assembly as by gluing the end flaps.
Figure 3:
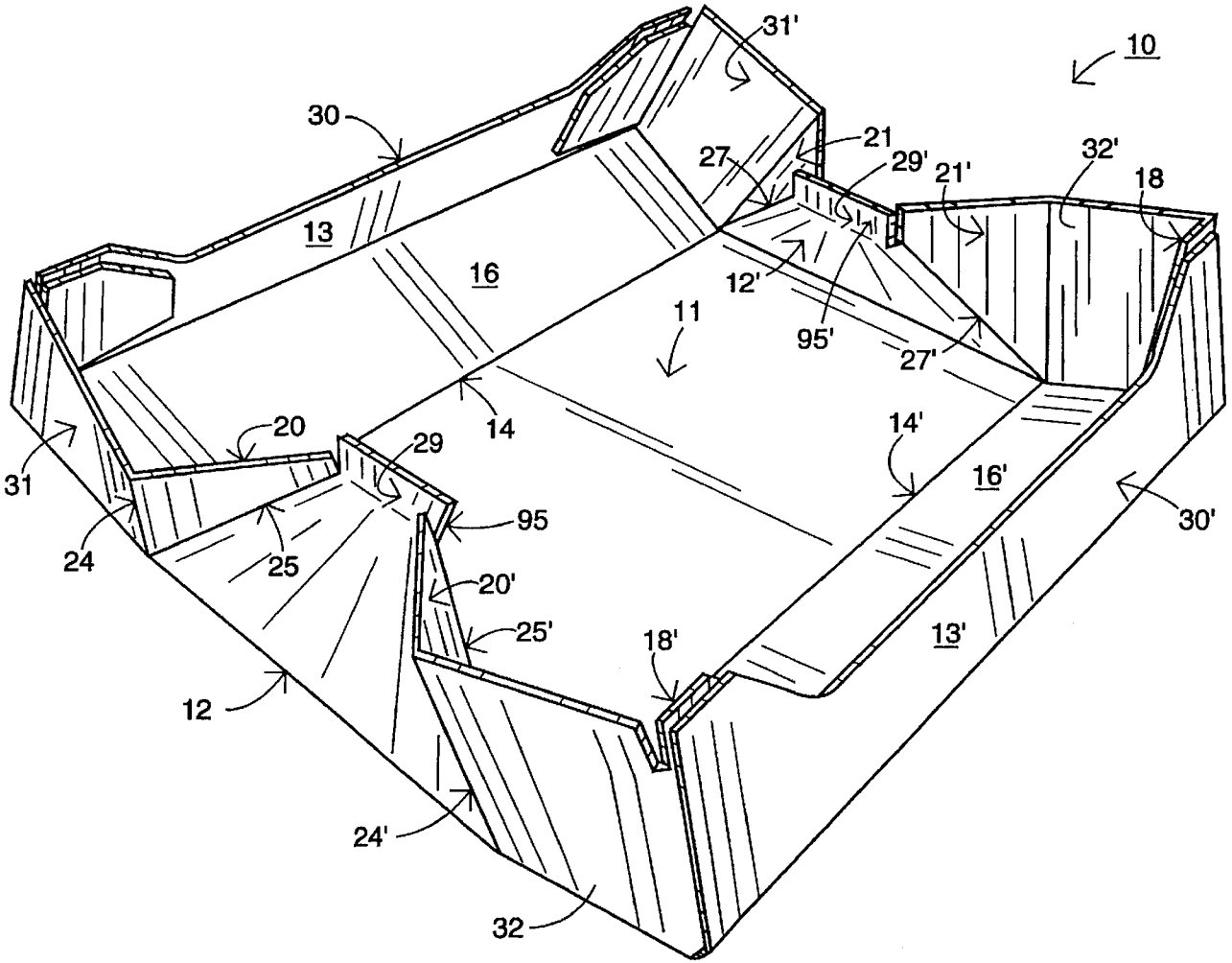
FIG. 3 depicts the tray as shown in FIG. 2 with one end assembly partially folded.
Figure 4:
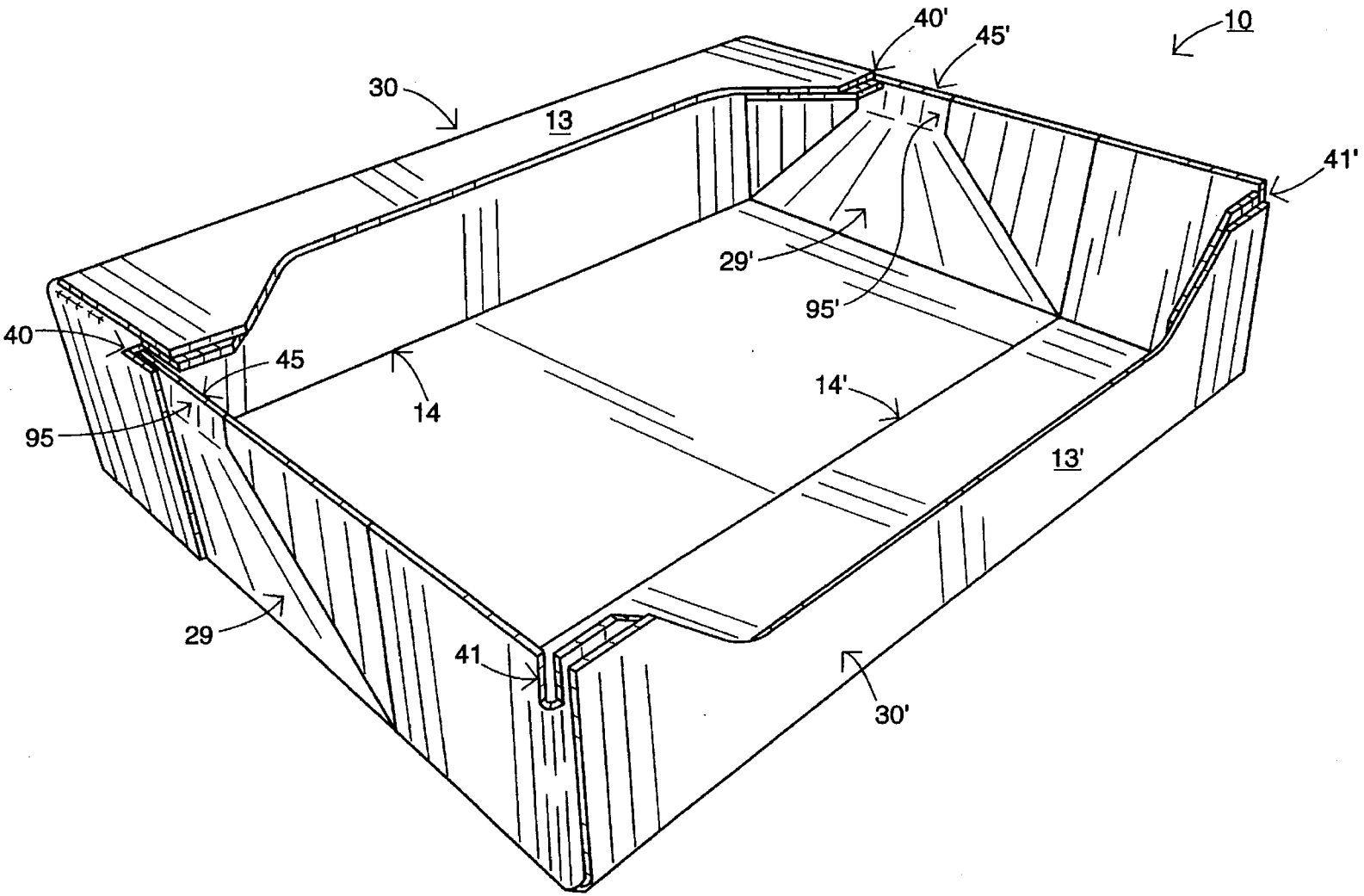
FIG. 4 pictures the tray of FIG. 3 with one end assembly fully folded and locked into a closed position.

The preferred form of the invention is shown in FIGS. 1–5 whereby a display tray is die-cut from a corrugated sheet having a thickness of about two millimeters. After die-cutting and scoring, the ends and sides are folded perpendicularly to the bottom and are adhesively attached to form a relatively square tray with the bottom being divided by two parallel score lines into two relatively short extreme sections and a longer central section. As seen in FIGS. 1 and 2 each side includes vertical and angular score lines which intersect in pairs on opposing sides proximate the pair of bottom score lines. As shown in FIGS. 3 and 4, the score lines form substantially wedge-shaped side segments along the sides to allow the end assemblies to fold. Notches formed in the top at the corners lock on to the side triangle-like section top edges to maintain the display tray in its folded configuration. The ends of the trays are each shown with a u-shaped upper edge so the end assemblies, when folded, form a large opening as featured in FIG. 5, through which merchandise contained within the display tray can be easily seen by a consumer in for example, a grocery or department store or other point-of-purchase.

After purchase by the consumer, the display tray can be used to maintain the merchandise therein. Should it be desirable to remove certain of the tray contents, one end assembly can be unfolded, removal made and the end assembly refolded and locked to maintain the remaining merchandise.

DETAILED DESCRIPTION OF THE DRAWINGS

For a better understanding of the invention and its operation, turning now to the drawings, FIG. 1 illustrates a top plan view of tray 10, the preferred form, as die-cut from conventional corrugated paper and includes a bottom 11, opposing sides 12, 12' and opposing ends 13, 13'. Ends 13 and 13' include concave portions 97 and 98, respectively. As shown, bottom 11 is divided by parallel score lines 14, 14' into a large central bottom section 15 and two smaller extreme sections 16, 16'.

In FIG. 2, tray 10 has been assembled by folding ends 13, 13' and sides 12, 12' upright into perpendicular alignment with bottom 11. Side flaps 17, 17' 18 and 18' have been also folded and adhesively attached such as with a hot melt adhesive or otherwise as is conventional in the art to ends 13, 13' respectively. As also shown in FIG. 2, pairs of wedge-shaped segments 20, 20' are formed by vertical score lines and angular score lines 25, 25' on side 12. Vertical score lines 26, 26' and angular score lines 27, 27' on opposite side 12' likewise define wedge-shaped segments 21, 21' Angular score lines 25, 25', 27, 27' are positioned at an approximate 45° angle from said vertical score lines. Thus as seen, each side has a pair of wedge-shaped segments which are foldable as depicted in FIG. 3. As also seen in FIG. 3, angular score lines 25, 25' define a triangle-like segment 29 along side 12 as do angular score lines 27, 27' define triangle-like segment 29' along side 12' when tray 10 is partially folded. Triangle-like segments 29, 29' bend inwardly along bottom 11 whereas wedge-shape segments 20, 20' 21, 21' pivot outwardly to allow end assemblies 30, 30' to pivot along score lines 14, 14'. Triangle-like segments 29, 29' include locking tabs 95 and 95', respectively. Locking tabs 95 and 95' extend from triangle-like segments 29 and 29' to engage corner notches 40 and 40'. Locking tabs 95 and 95' include top edges 45 and 45', respectively. End assembly 30 is formed of end 13, side segments 31, 31' and bottom extreme section 16. End assembly 30' is formed from side segments 32, 32', bottom extreme section 16' and end 13' which is joined to side segments 32, 32' by end flaps 18, 18' respectively. End assembly 30 rotates during folding so end 13 is parallel to bottom 11 when fully closed.

End assembly 30 is seen fully folded or closed in FIG. 4 whereas end assembly 30' is open. Product, such as bags of animal crackers, potato chips or other goods, can easily be placed within tray 10 and thereafter end assembly 30, 30' closed to secure said goods. As shown in FIG. 4, corner notches 40, 40' engage top edges 45, 45' of locking tabs 95 and 95' of, respectively, triangle-like segments 29, 29'. Corner notches are likewise available for engaging top edges 45, 45' when end assembly 30' is folded. Notches 40, 40', 41, 41' permit locking of end assemblies 30, 30' when folded to prevent product contained therein from inadvertent removal. Should it be desirable to open end assemblies 30, 30', then by applying inward manual pressure to triangular-like segments 29, 29', locking notches 40, 40',41, and 41' are opened or unlocked. End assemblies 30, 30' are then free to fully open.

Figure 5:
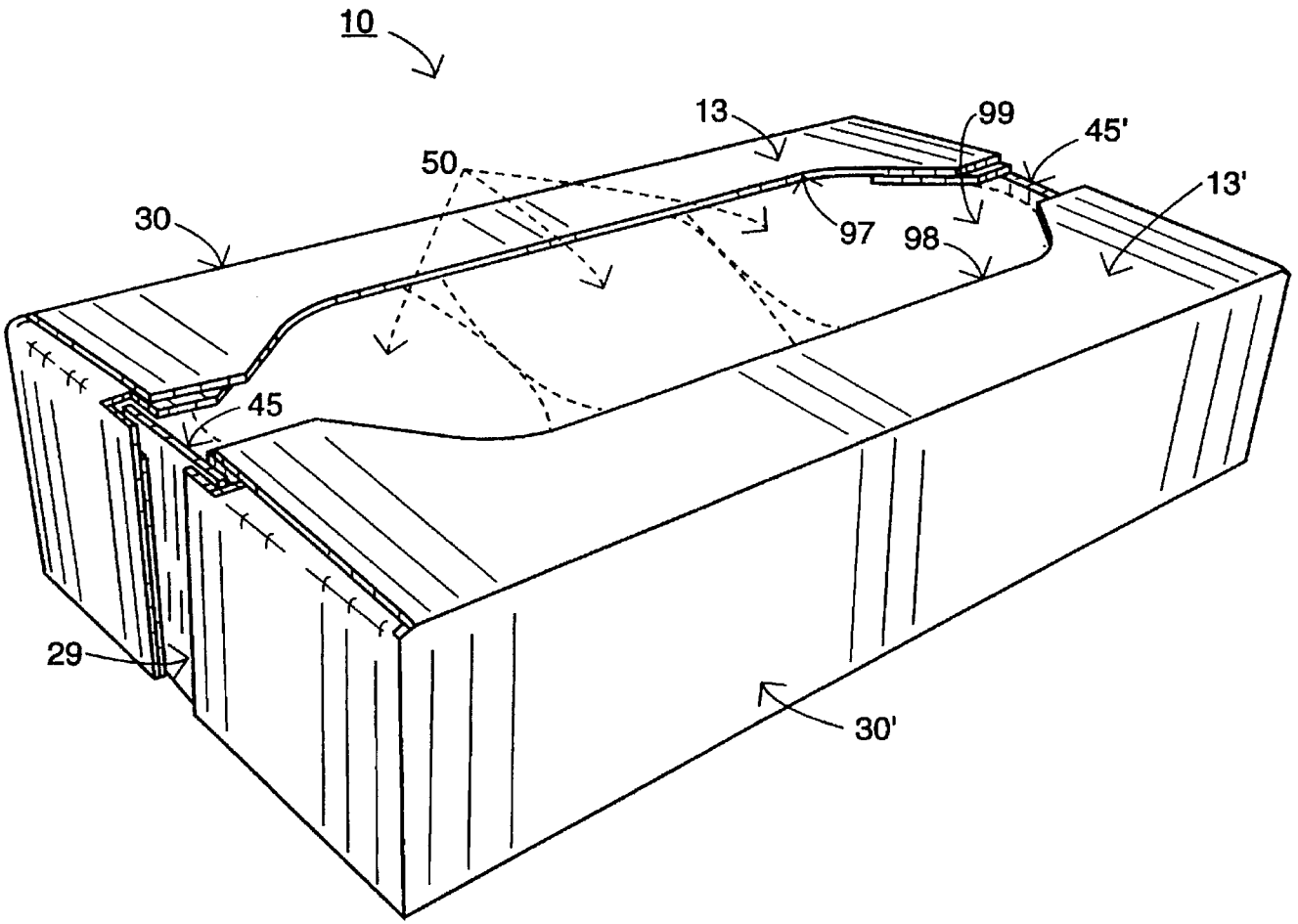
FIG. 5 features the tray of FIG. 4 with both end assemblies fully folded and locked in place with merchandise displayed therein.

In FIG. 5, tray 10 is shown fully folded with ends assemblies 30, 30' locked in place as previously described to securely contain imaginary bags 50 which may consist of flexible plastic bags of animal crackers. Thus, tray 10 may contain six such bags (in two layers) and can be used by the consumer as a convenient storage container as bags 50 may be removed one at a time therefrom through access aperture 99 defined by concave portions 97 and 98 of ends 13 and 13'.

Figure 6:
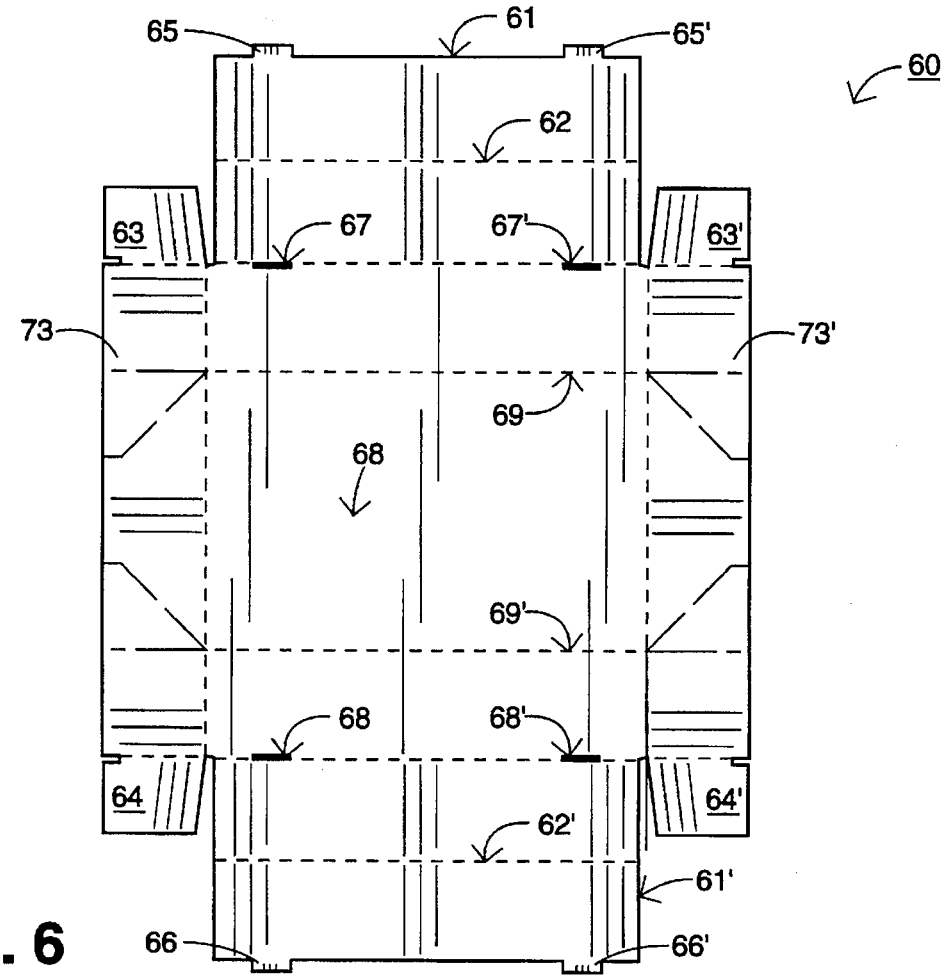
FIG. 6 provides a second embodiment of the invention in an unassembled fashion.
Figure 7:
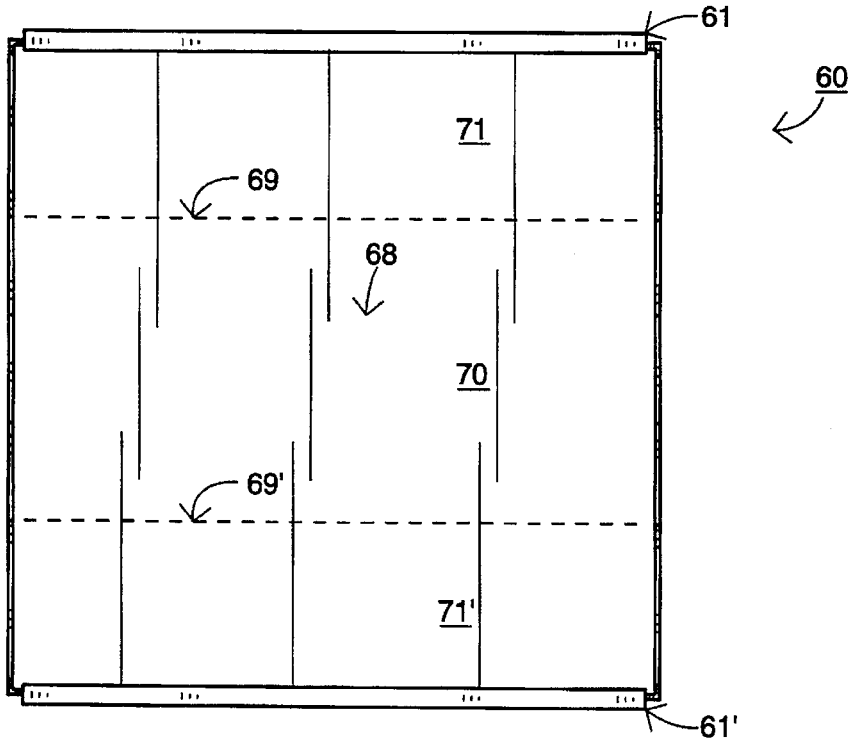
FIG. 7 depicts a top view of the embodiment of FIG. 6 assembled.
Figure 8:
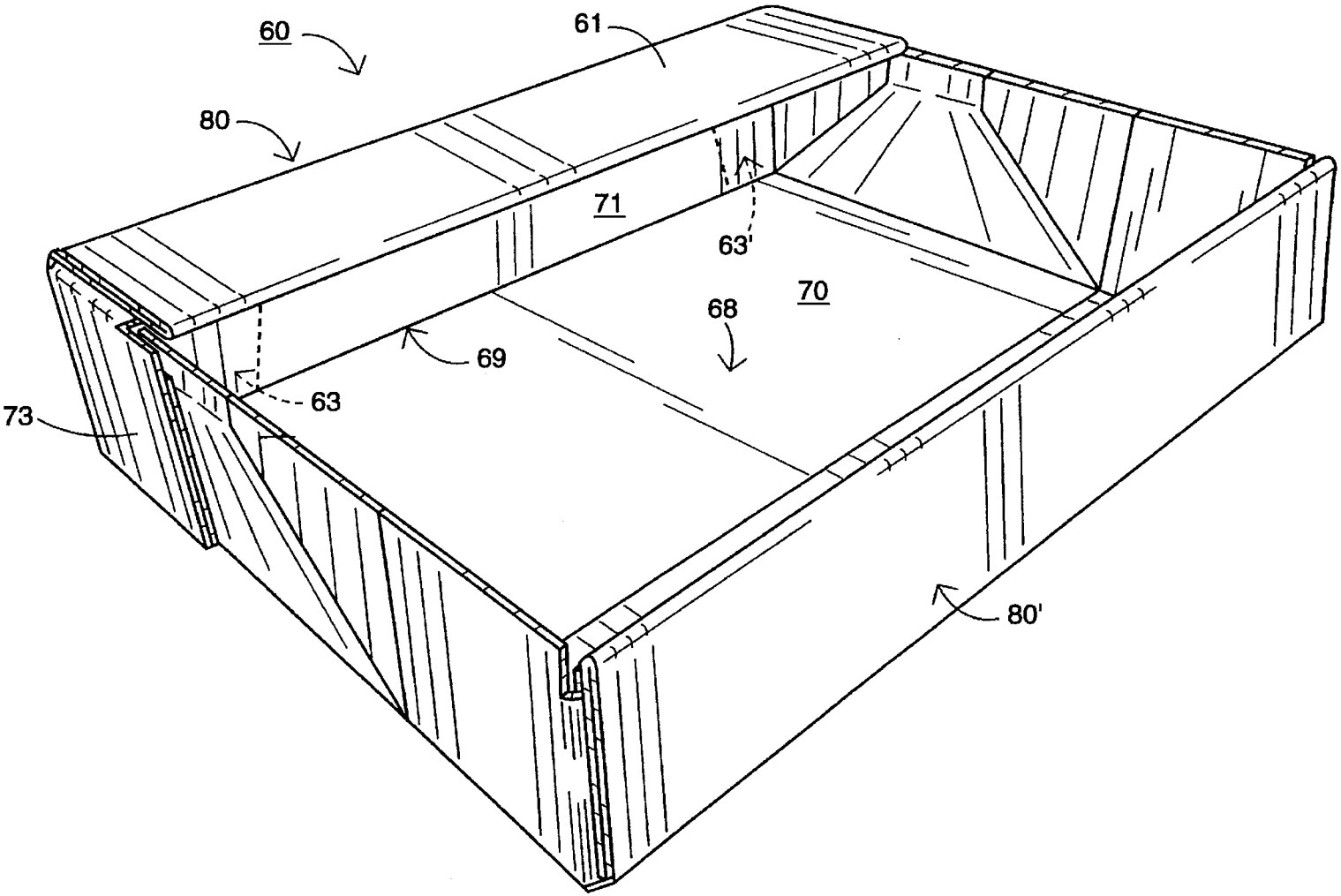
FIG. 8 illustrates a perspective view of the embodiment of FIG. 7 with one end assembly fully folded and the other end assembly open.
Figure 9:
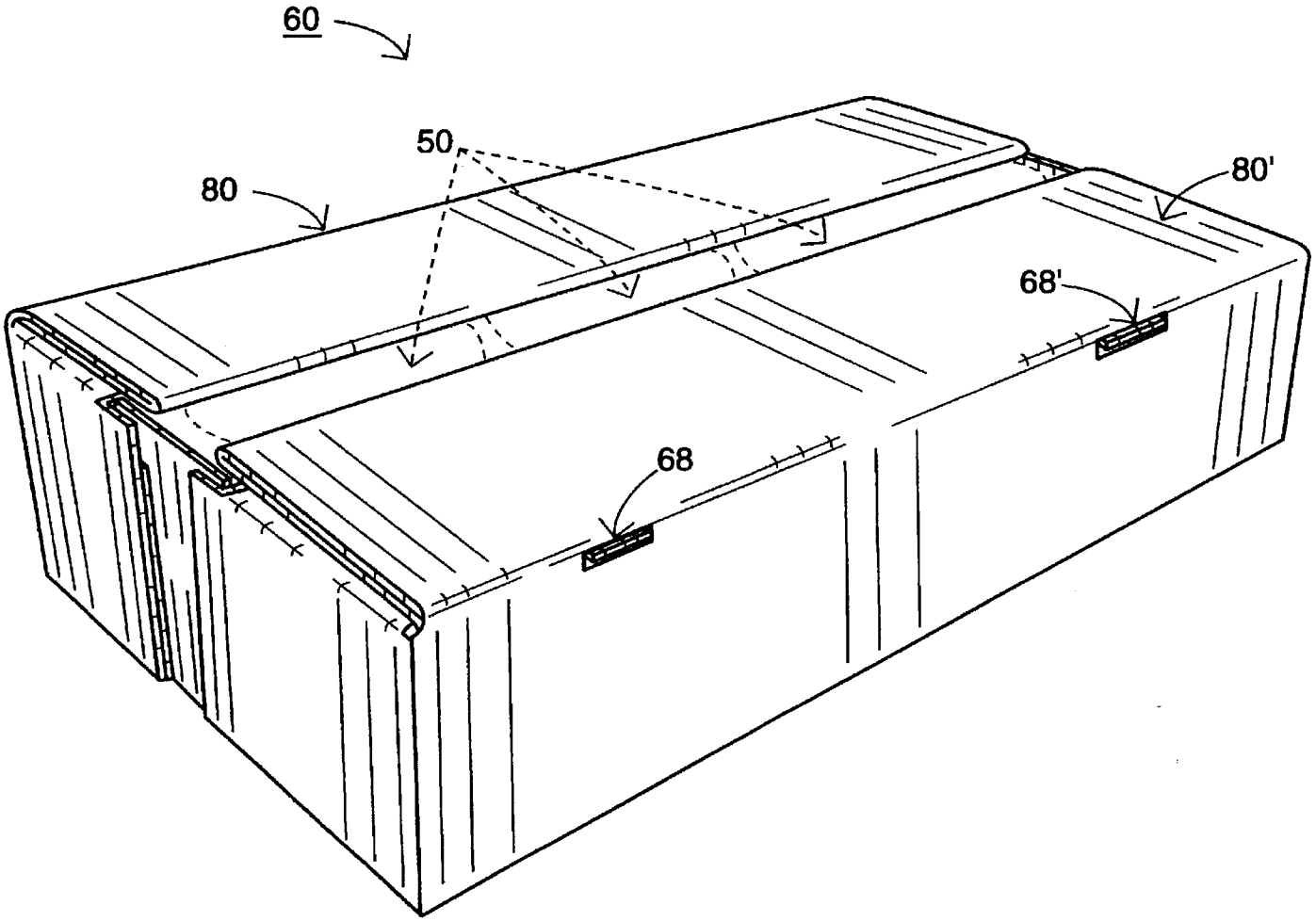
FIG. 9 demonstrates the embodiment of FIG. 8 with both end assemblies fully folded.

A second embodiment of the invention is seen in FIGS. 6–9 whereby tray 60 is shown in FIG. 6 as die-cut from corrugated paper and unassembled. Tray 60 includes ends 61, 61' which include parallel score lines 62, 62' respectively which allow folding over of end flaps 63, 63', 64 and 64' with tabs 65, 65', 66 and 66' engaging respectively tab slots 67, 67', 68 and 68'. Thus, ends 61, 61' fold and provide a double-end thickness and do not employ adhesives as does tray 10 seen in FIG. 1 for assembly. Bottom 68 is shown in FIG. 7 with tray 60 in an assembled configuration. Bottom 68 is divided by score lines 69, 69' into a large central section 70 and two smaller connected extreme sections 71, 71'. End assemblies 80 and 80' are seen in FIG. 8 in a perspective view whereby end assembly 80 is folded and end assembly 81 is unfolded. End assembly 80 consists of extreme section 71, side segments 73, 73' (FIG. 6) and end flaps 63, 63' End assembly 80 is folded along score line 69 whereby bottom extreme section 71 is perpendicularly positioned relative to bottom central section 70. Tray 60 in FIG. 9 is shown with end assemblies 80, 80' in a folded posture containing imaginary product bags 50.

Figure 10:
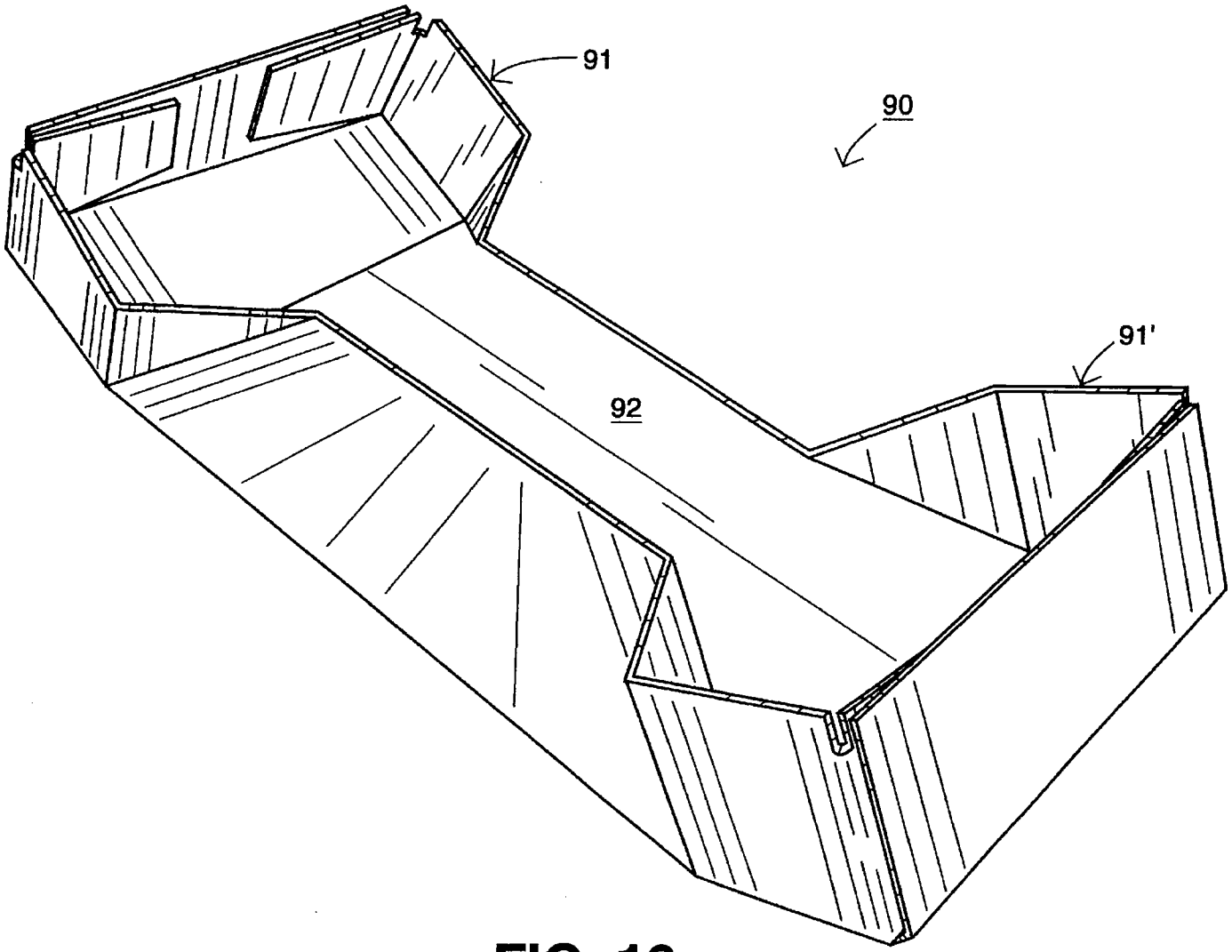
FIG. 10 shows yet another embodiment of the invention assembled with both end assemblies partially folded.

Another embodiment of the invention is seen in FIG. 10 whereby tray 90 is assembled by the use of a hot melt adhesive or the like. Tray 90 includes end assemblies 91, 91' which are partially folded. Tray 90 is similar to tray 10 as seen in FIG. 3 but it has bottom central section 92 with a greater length than width to provide an elongated-type tray.

The examples and illustrations provided herein are merely for explanatory purposes and those skilled in the art can make various changes thereto without departing from the scope of the appended claims.

I claim:

1. A foldable tray comprising: a bottom, opposing sides, opposing ends, each of said opposing ends having a concave portion, said sides and said ends perpendicularly joined to said bottom, said ends each connected to both of said sides, said opposing sides each defining a pair of vertical score lines and a pair of angular score lines, one each of said vertical score lines and one each of said angular score lines intersecting proximate said bottom, said bottom defining a pair of parallel score lines extending from said intersection on a first one of said sides to the intersection on an opposite one of said sides whereby said sides can be partially folded along said vertical and said angular score lines while said bottom is folded along said parallel score line to allow said ends to align parallel with said bottom so said concave portions oppose to define an access aperture.

2. The foldable tray of claim 1 wherein each of said sides define a locking notch.

3. The foldable tray of claim 2 wherein each of said sides has a top edge, and one each of said locking notches receives one each of the top edges when said container is folded.

4. A foldable tray comprising: a bottom, opposing sides, opposing ends, each of said opposing ends having a concave portion, said opposing sides and said opposing ends perpendicularly joined to said bottom, said ends each connected to both of said sides, said bottom defining a pair of parallel score lines extending from a first of said sides to an opposite one of said sides, said bottom score lines dividing said bottom into a central and two extreme sections, each of said sides defining a pair of vertical score lines and a pair of angular score lines, one each of said vertical and said angular score lines on each side intersecting proximate each of said bottom parallel score lines whereby each end can be raised upwardly with each side by folding along said angular and said vertical score lines and said bottom folding along said parallel score lines to allow said ends to be aligned parallel to said central bottom section and to allow the concave portions to define an access aperture through which the contents of said tray may be removed when said tray is so folded.

5. The foldable tray of claim 4 formed from paper.

6. The foldable tray of claim 5 formed from corrugated paper.

7. The foldable tray of claim 4 wherein said extreme sections are each smaller than said central bottom section.

8. The foldable tray of claim 4 wherein said opposing ends are each adhesively fastened to both of said opposing sides.

9. The foldable tray of claim 4 wherein said opposing ends and said opposing sides are integrally formed with said bottom.

10. The foldable tray of claim 4 wherein each of said sides has a top edge, said ends and said sides define locking notches, said locking notches for engagement with the top edges of said sides when said ends are raised in to a parallel position relative to said central bottom section.

11. The foldable tray of claim 4 wherein said angular score lines are at approximately forty-five degrees relative to said vertical score lines.

12. A foldable tray, comprising:

(a) a rectangular bottom, said bottom defining a pair of parallel score lines, said pair of parallel score lines dividing said bottom into a first and a second extreme section and a central section between said extreme sections, and each of said extreme sections being foldable along one of said score lines between an open and a closed position;

(b) a pair of sides, each of said sides being foldably attached to opposite edges of said bottom, each of said sides defining a first and a second vertical score line and a first and a second angular score line, said first vertical score line and said first angular score line defining a first foldable wedge-shaped segment, said second vertical score line and said second angular score line defining a second foldable wedge-shaped segment, said first and second angular score lines defining a triangular portion, said triangular portion including a locking tab, said locking tab extending from said triangular portion, each of said sides including a foldable flap, each of said flaps attached to one of said sides, each of said sides defining a corner notch proximate the flap, and said locking tab being insertable into and engagable with said corner notch when the first extreme sections is in the folded position; and (c) a pair of ends, said ends each being foldably attached to opposite edges of said bottom.

13. The foldable tray of claim 12 wherein said ends and said sides are joined.

14. The foldable tray of claim 12 formed from paper.

15. The foldable tray of claim 12 formed from corrugated paper.

16. The foldable tray of claim 12 wherein said extreme sections are each smaller than said central section.

17. The foldable tray of claim 12 wherein said opposing ends each have a concave portion.

18. The foldable tray of claim 12 wherein said opposing ends and said opposing sides are integrally formed with said bottom.

19. The foldable tray of claim 12 wherein said angular score lines are at approximately forty-five degrees relative to said vertical score lines.

* * * * *